United States Patent [19]

Su

[11] Patent Number: 5,000,714

[45] Date of Patent: Mar. 19, 1991

[54] ELECTRONICALLY CONTROLLED DOLL EYES

[76] Inventor: Michael Su, No. 6, Lane 327, Nan San Rd., Chung Ho City, Taipei, Taiwan

[21] Appl. No.: 422,607

[22] Filed: Oct. 17, 1989

[51] Int. Cl.[5] ..... A63H 3/38

[52] U.S. Cl. ..... 446/392; 446/485

[58] Field of Search ..... 446/392, 485, 219, 389

[56] References Cited

U.S. PATENT DOCUMENTS 2,370,601 2/1945 Wimpfheimer et al. ..... 446/485 X
2,670,569 3/1954 Heina ..... 446/392
4,305,223 12/1981 Ho ..... 446/392

FOREIGN PATENT DOCUMENTS 778438 7/1957 United Kingdom ..... 446/485

*Primary Examiner*—Mickey Yu
*Attorney, Agent, or Firm*—Morton J. Rosenberg; David I. Klein

[57] ABSTRACT

The subject invention system relates to an electronically controlled doll eye and in particular, relates to a simulated doll eye having a screen portion, a transparent film portion, and a reflector as well as a light emitter portion. The light emitter portion emits light and projects an image formed on the transparent film portion onto the screen portion. By allowing variation in the light emitting direction, the image will be displayed at different positions on the screen and provides for doll animation of the doll eyeball.

2 Claims, 5 Drawing Sheets

ELECTRONICALLY CONTROLLED DOLL EYES

BACKGROUND OF THE INVENTION

Dolls have been a popular toy for children throughout the ages. Due to the vast popularity of dolls, the prior art in this field has been numerous. However, most of the prior art doll systems concentrate on doll appearance or dress, however, seldom has any attention been paid to the animation and simulation of doll eyes.

In opposition to the prior art, the subject invention system is directed to electronically controlled doll eyes where an image is projected at different locations on a substantially hemispherically contoured screen which simulates the outer surface of the eye and thus, gives the eyeball of the doll an animated and realistic effect.

SUMMARY OF THE INVENTION

A primary object of the present invention system is to provide an electronically controlled pair of doll eyes which allows for animation and provides a lively visual effect.

It is a further object of the subject invention system to provide a doll having electronically controlled doll eyes which is unique and increases the value of the overall doll system.

It is a still further object of the present invention system to provide electronically controlled doll eyes which are inexpensive to produce and which can be manufactured in quantity.

BRIEF DESCRIPTION OF THE DRAWINGS

FIGS. 4A–8A are elevational cross-sectional views of the present invention system showing light being projected in different areas on a hemispherical screen;

FIGS. 4B–8B are plan views of the present invention system showing image display at different positions on the hemispherical screen; and, FIG. 9 is an electrical circuit diagram of the light emitting portion of the present invention system.

DETAILED DESCRIPTION OF THE PREFERRED EMBODIMENTS

Figure 1:
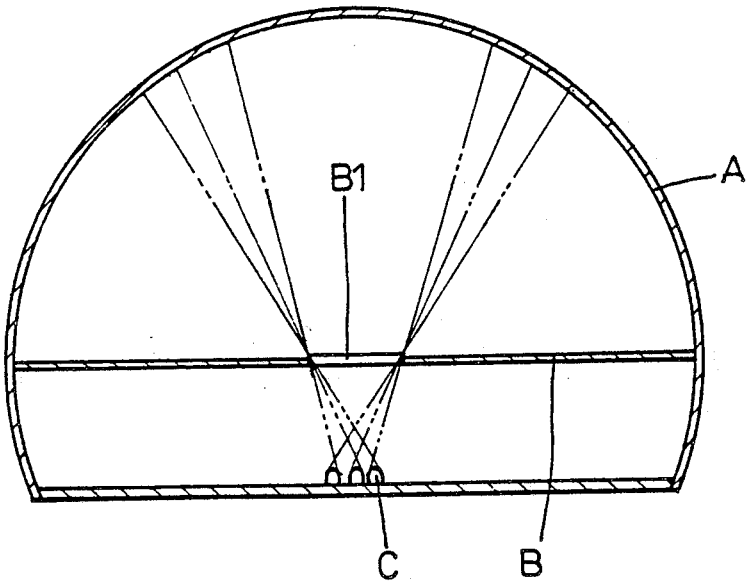
FIG. 1 is a schematic representation of the present invention system showing the electronically controlled doll eyes.

Referring now to FIG. 1, there is shown the schematic structure of the present invention system of an electronically controlled doll eye which comprises a screen portion A, a transparent film portion B, and a light source C.

The screen portion A is a substantially hemispherically shaped screen which is a simulation of the outer surface of an eye which may be formed of a white material and is diaphanous in texture, but is not totally transparent. The transparent film portion B includs an image, drawing or other figure contour B1 located in the center of the film portion B for projection therearound by the light source C onto the screen portion A.

By changing the transparent film, the screen B may be used to provide different colors such as brown, black or light blue projections to simulate different eye colors. The light projection direction of the eyeballs may be changed by changing the light to provide different visual effects.

The following paragraphs direct themselves to a particular example to provide an understanding of the present invention, however, it is to be understood that this particular example is not deemed as a limitation to the invention concept as claimed. Other systems that include the screen portion A, transparent film portion B and light source C as described above are included under the scope of this invention as claimed.

Figure 2:
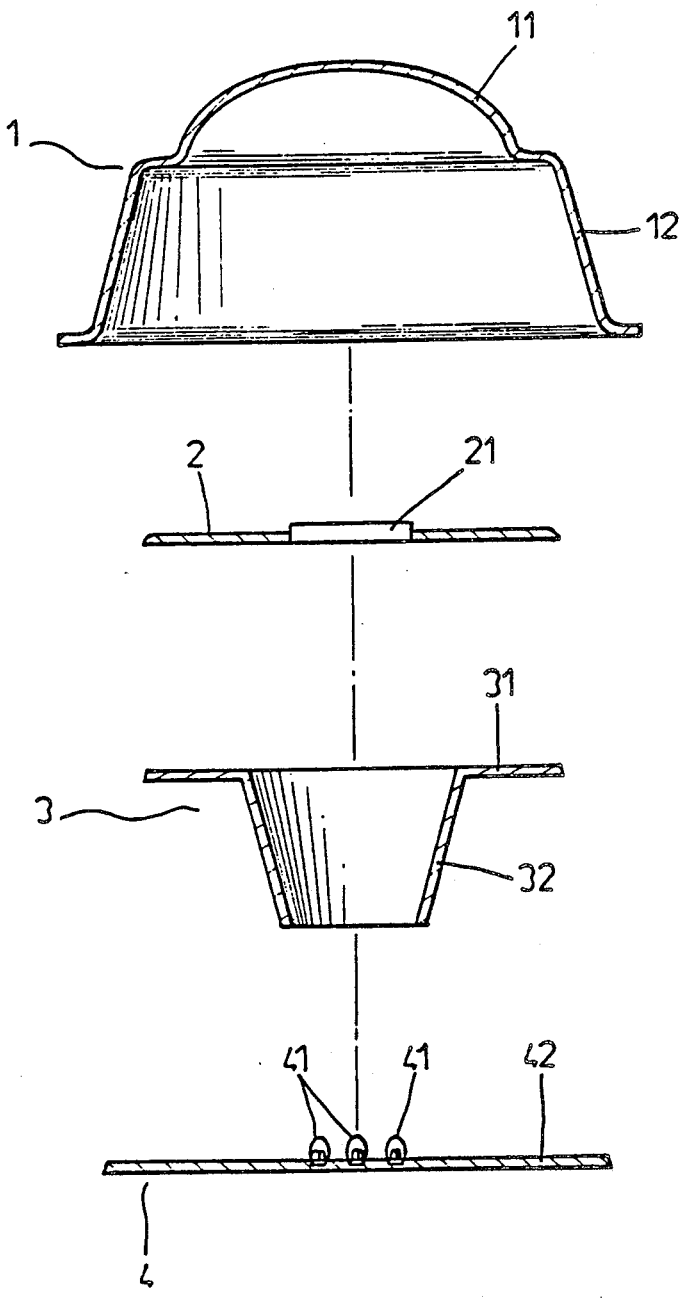
FIG. 2 is an elevational exploded view of the present invention system.
Figure 4B:
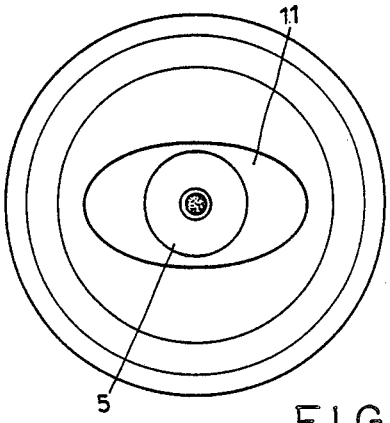
Figure 4A:
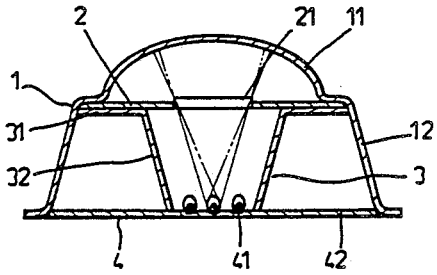
Figure 5B:
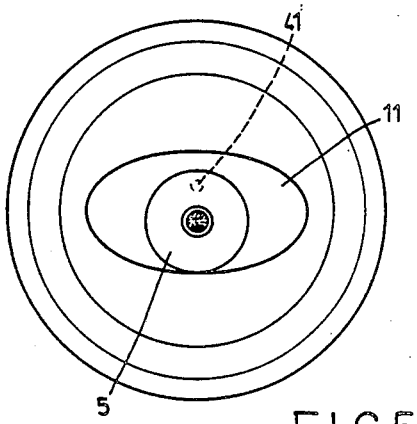
Figure 5A:
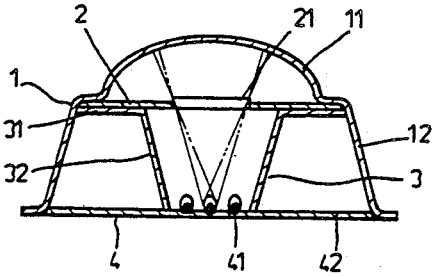
Figure 6B:
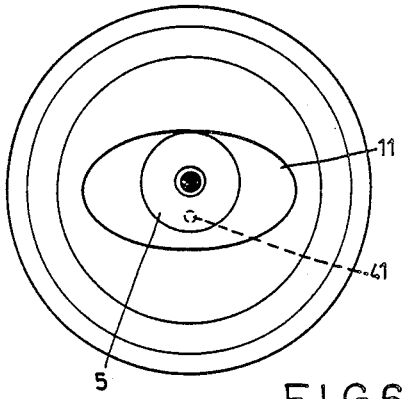
Figure 6A:
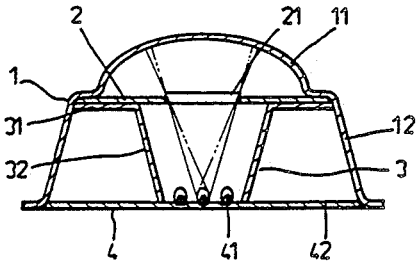

The screen 11 as shown in FIG. 2 is a non-transparent, but diaphanous hemispherically shaped screen which simulates the eyeball of a human being or other animal.

Figure 3:
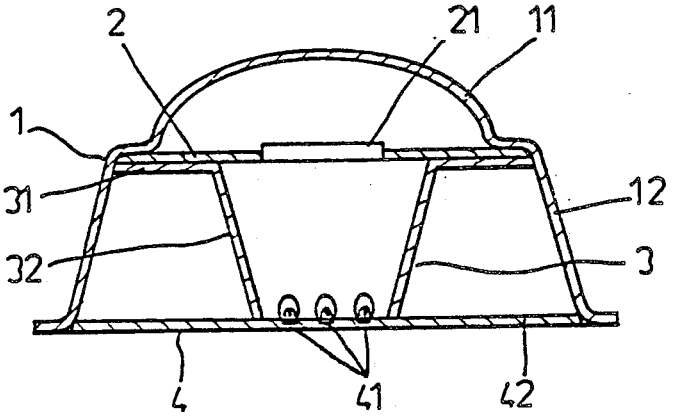
FIG. 3 is an elevational cross-sectional view of the subject invention system.

Reference is now made to FIGS. 2 and 3 which shown different views of the present invention system. The present system, according to this invention, includes four portions which include the screen portion 1 having a screen 11 and a conically shaped cover 12, as well as the transparent film portion 2, having an image or drawing 21 formed thereon. The reflector portion 3 has a rim 31 and a reflector cup 32 with the light emitting portion 4 including a plurality of lightbulbs 41 and a board member 42 having an electrical circuit mounted thereon.

When assembled, as shown in FIG. 3, the transparent film portion 2 is located under the screen 11 of the screen portion 1 and is sandwiched between the rim 31 and a shoulder of the screen portion 1. The light emitting portion 4 forms a base and an enclosure for the overall structure.

Figure 7B:
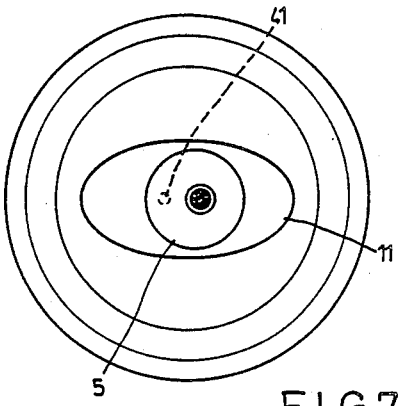
Figure 7A:
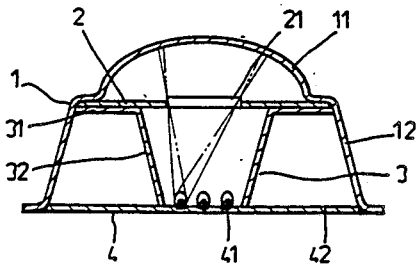
Figure 8B:
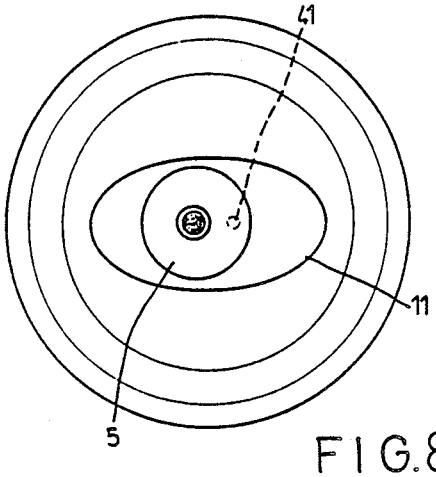
Figure 8A:
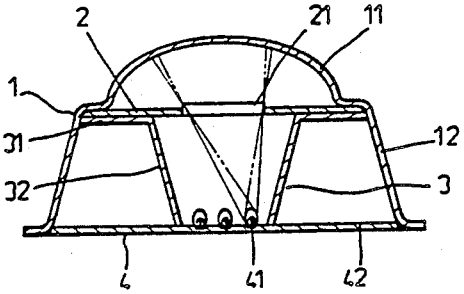
Figure 9:
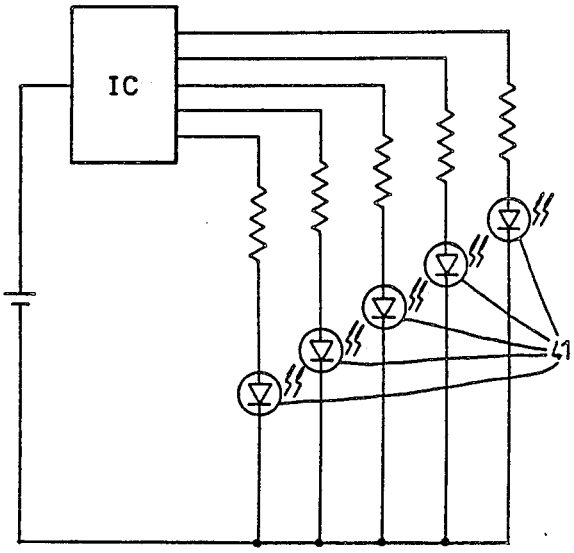

When the image 21 is projected by a central bulb 41, the image will be displayed at the center of the screen 11. If the bulb 41 on the left, as shown in FIG. 7A, is energized, the image 21 is projected to the right as shown in FIG. 7B. In like manner, if the bulb 41 on the right, as shown in FIG. 8A, is energized, the image 21 is projected to the left, as shown in FIG. 8B. Changes of the light emission direction from bulbs 41 are controlled by the electrical circuit diagram of FIG. 9 where each diode is controlled by an integrated circuit (IC) board well-known in the art.

It is to be understood that the forms of the inventions herewith shown and described are to be taken as preferred examples of the invention concept and that various shapes, drawings of the elements and arrangements may be resorted to, without departing from the spirit of the invention, or the scope of the claims.

I claim:

1. An electronically controlled doll eye comprising:

(a) a hemispherically contoured diaphanous screen portion;

(b) a transparent film portion having an image formed thereon; and, (c) a light emitting portion having a plurality of light source members mounted on a board member, each of said light source members being located at different positions on said board member, whereby said light source members may be activated individually to project light through said transparent film and project said image onto said screen portion at predetermined locations.

2. The electronically controlled doll eye as recited in claim 1 where said screen portion includes a conically shaped cover member formed at a lower portion of said hemispherically contoured screen portion, said light emitting portion including a reflector member mounted on said board member, said transparent film being sandwiched between said reflector member and a shoulder of said screen portion, said light emitting portion further including an electrical circuit having a plurality of light emitting diode members whereby when said light emitting diode members are activated, said image is displayed onto said screen at predetermined locations.

* * * * *